US007789138B2

(12) United States Patent
McGarian et al.

(10) Patent No.: US 7,789,138 B2
(45) Date of Patent: Sep. 7, 2010

(54) WELL CASING STRADDLE ASSEMBLY

(75) Inventors: Bruce McGarian, Aberdeen (GB); Gary Pape, Niaku (CA)

(73) Assignee: Smith International, Inc., Houston, TX (US)

( * ) Notice: Subject to any disclaimer, the term of this patent is extended or adjusted under 35 U.S.C. 154(b) by 642 days.

(21) Appl. No.: 11/200,244

(22) Filed: Aug. 10, 2005

(65) Prior Publication Data

US 2006/0032628 A1 Feb. 16, 2006

(30) Foreign Application Priority Data

Aug. 10, 2004 (GB) ..... 0417765.5

(51) Int. Cl.
*E21B 33/128* (2006.01)

(52) U.S. Cl. ..... 166/191; 277/337

(58) Field of Classification Search ..... 166/191, 166/196, 138; 277/336, 337, 339
See application file for complete search history.

(56) References Cited

U.S. PATENT DOCUMENTS 2,612,953 A * 10/1952 Morgan et al. ..... 277/340
3,948,321 A 4/1976 Owen et al.
5,692,564 A 12/1997 Brooks
6,026,899 A * 2/2000 Arizmendi et al. ..... 166/216
6,276,690 B1 * 8/2001 Gazewood ..... 277/336
6,752,216 B2 * 6/2004 Coon ..... 166/387
6,814,143 B2 * 11/2004 Braddick ..... 166/277
6,997,266 B2 * 2/2006 Jackson et al. ..... 166/384
7,096,938 B2 * 8/2006 Carmody et al. ..... 166/134
7,341,110 B2 * 3/2008 Doane et al. ..... 166/387
2002/0011341 A1 1/2002 Ingram et al.
2003/0116328 A1 * 6/2003 Doane et al. ..... 166/387
2006/0065391 A1 * 3/2006 Carr ..... 166/242.6
2006/0102361 A1 * 5/2006 Fay et al. ..... 166/387

* cited by examiner

*Primary Examiner*—Daniel P Stephenson
(74) *Attorney, Agent, or Firm*—Dykema Gossett PLLC

(57) ABSTRACT

A well casing assembly comprises a length of line having two packer/seal assemblies at the upper end thereof and two packer/seal assemblies at the lower end thereof. The lower end packer/seal assemblies are inverted relative to the upper end packer/seal assemblies. By appropriate design of the setting elements of the packer/seal assemblies, each is selected to have a different setting force. Accordingly, when the tool is set by longitudinal compression thereof, the packer/seal assemblies set in a pre-determined sequence. The packer/seal assemblies are preferably of the type in which an annular slip is expanded by means of a swage. Variations in the setting force may be obtained by variations in material characteristics and/or thickness or by variations in the swage ramp angle, or by any other suitable means.

12 Claims, 6 Drawing Sheets

WELL CASING STRADDLE ASSEMBLY

BACKGROUND OF THE INVENTION a. Field of the Invention

The present application claims the benefit of priority to United Kingdom Application No. 0417765.5 filed Aug. 10, 2004, hereby incorporated by reference in its entirety.

This invention relates to a well casing straddle assembly, that is to say an assembly comprising a liner and at least one packer/seal at the top and at the bottom of the liner so that the assembly can be set in a well casing to isolate a length of the casing from the well bore. A straddle assembly is typically used to repair defective casing or to isolate openings in the casing (for example perforations or window openings) from the well bore.

b. Description of Related Art

The use of straddle assemblies is well known in the oil industry. A typical straddle assembly is described in U.S. Pat. No. 3,948,321 and comprises a packer/seal assembly located at both the top and the bottom end of a length of liner. In use, the assembly is run into a well and the packer/seal assemblies are set to hold the straddle assembly in place and provide a fluid tight seal between the assembly and casing at the top and bottom of the assembly.

In general, it is desirable for the inside diameter of the assembly to be as large as possible relative to the inside diameter of the casing in which it is set and to this end the packer/seal assemblies are designed to provide the maximum available internal diameter.

In many applications it would be desirable to have more than one packer/seal assembly at the top and/or at the bottom of the straddle assembly. Typically, in many applications it would be desirable to have two packer/seal assemblies at the top of the straddle assembly and two packer/seal assemblies at the bottom of the straddle assembly. However, attempts to implement designs using a total of four packer/seal assemblies have not been entirely satisfactory. The problem arises from the method which is used to set the packer/seal assemblies. In the prior art, a setting tool is deployed within the straddle assembly and latched onto a suitable collar provided at the lower end of the assembly. Means are provided on the setting tool adjacent the upper end of the assembly to provide a reaction surface against which the straddle assembly could be pulled by the setting tool. Once movement of the upper end of the straddle assembly had been arrested, continued action of the setting tool applies an axially compressive force to the straddle assembly to set the packers. Although all four packers would, theoretically, have equal setting forces, in practice manufacturing tolerances, wear, well conditions, etc. mean that the packers set in an order which could not be predicted. If, in fact, the packers nearest the top and bottom of the assembly set before the packers nearer the centre of the assembly, further movement of the setting tool was arrested and the packers nearer the centre of the tool were not, in fact, set at all. This was obviously highly undesirable. Although it would be possible, in theory, to devise a setting tool which could selectively set each of the packers in turn, such a design would be complex and difficult to operate under field conditions.

Accordingly, it is an object of the present invention to provide a well casing straddle assembly having a plurality of packer/seal assemblies in which the sequence of setting of the packer/seal assemblies can be selected, thereby allowing optimum setting.

The ability to select the setting order is particularly critical in a straddle assembly of the type which includes two or more packer/seal assemblies at the top of the straddle assembly and a further two or more packer/seal assemblies at the bottom of the straddle assembly. However, it should be understood that the ability to select the setting order may be of significant utility even in designs in which there is only one packer/seal assembly at each end of the straddle assembly. In particular, the ability to set the packer at the end of the straddle assembly which is fixed relative to the well casing during the setting procedure, before setting the packer/seal assembly at the other end of the straddle assembly, is highly desirable since it avoids the possibility of the packer/seal assembly at the moveable end of the straddle assembly being set prematurely and thereby resisting further movement of the setting tool.

SUMMARY OF THE INVENTION

In accordance with the first aspect of the present invention a well casing straddle assembly comprises a length of straddle liner having a packer located at either end thereof wherein the packers require different setting forces so that if the assembly is longitudinally compressed by a setting tool the packers will set in a predetermined sequence.

Preferably, each packer comprises an annular slip which, during setting, is expanded into gripping engagement with the surrounding casing by forcing a tapering swage into the slip. With such a design, the setting force necessary maybe selected by appropriate design characteristics of the slip and/or swage. For example, even if the slips are identical, the axial force necessary to set the slip can be controlled within certain limits by varying the ramp angle of the swedge. Additionally or alternatively, if the swage is connected to the body on which the swage is mounted by a ratchet mechanism to prevent inadvertent release of the swage, appropriate design of the ratchet mechanism may be used to vary the force necessary to drive the swage into setting engagement with the slip. In particular, if the ratchet mechanism comprises a plurality of wickers on the swage with ratchet teeth which snap over corresponding ratchet teeth provided on the slip body, the degree of flexibility of the wickers may be selected to select the setting force necessary to set the packer. The stiffer the wickers, the greater the force necessary to snap the wicker teeth over the teeth on the slip body and hence the greater the force necessary to set the packer.

The stiffness of the wickers may be selected by a number of mechanisms. For example, the wickers may be formed by providing a helical thread on the end of the swage and providing one or more longitudinal grooves which cut through the full thickness of the swage to separate the threaded portion into a plurality of wickers. The more slots which are provided, the greater will be the number of wickers but the lower will be the force necessary to deflect the wickers so that they can snap over the thread provided on the swage body. Thus, two otherwise identical packer assemblies can be arranged to set a different forces by providing one with two slots and thus two wickers whilst the other is provided with four slots and thus four wickers.

Additionally or alternatively, the setting force for any one of the packer/seal assemblies can be controlled by appropriate selection of the yield characteristics of the slips. If the slip of a particular packer/seal assembly is made relatively thin or of a relatively easily deformable material the setting force of that packer/seal assembly will be lower than that of a corresponding packer/seal assembly having a slip of thicker or relatively less easily deformable material. Accordingly, by appropriate design a plurality of packer/seal assemblies may be produced having known variations in the required setting force.

Additionally or alternatively, one or more of the slips may be designed to provide a lower gripping force when partially set. This can be achieved, for example, by providing one slip with pointed teeth whilst on another slip the points are removed so that the teeth do not easily dig into the casing. With such an arrangement even if the slip with the points removed becomes partially set it will be able to skid over the surface of the casing to permit full setting of the other slip before the slip with the points removed is itself fully set by continued operation of the setting tool.

BRIEF DESCRIPTION OF THE DRAWINGS

The invention will be better understood from the following description of a preferred embodiment thereof, given by way of example only, reference being had to the accompanying drawings wherein.

DETAILED DESCRIPTION OF THE PREFERRED EMBODIMENT

Figure 1:
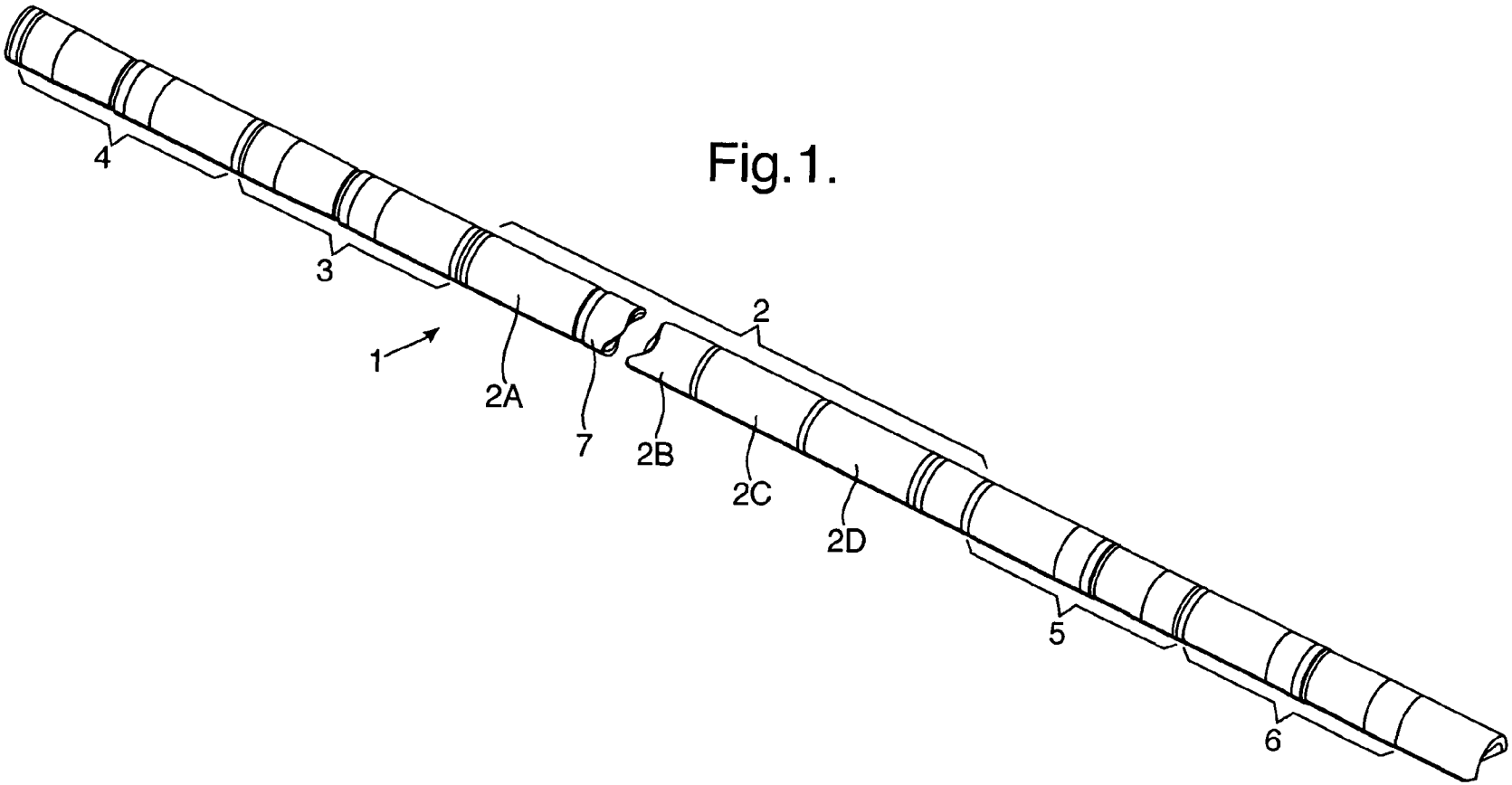
FIG. 1 illustrates schematically a well casing straddle assembly in accordance with a preferred embodiment of the present invention.

Referring now to the drawings, the illustrated well casing straddle assembly 1 comprises a length of liner 2 having two packer/seal assemblies 3, 4 at the upper end thereof and two packer/seal assemblies 5, 6 at the lower end thereof. The packer/seal assemblies 5, 6 are inverted relative to the packer/seal assemblies 3, 4 but all the packer/seal assemblies are substantially identical to each other save that at least one of the packer/seal assemblies requires a lower force to set it than at least one other of the packer/seal assemblies.

The liner 2 is made up of a plurality 2A, 2B, 2C, 2D of tubing sections 7 which are connected together in conventional manner to make the required length. The length of the liner section 2 will, of course, depend upon the intended use of the assembly but will typically vary from a few meters to a few hundreds of meters according to the application.

The illustrated straddle assembly will be set in conventional manner by running it into a well bore with a setting tool which is operated to apply an axially compressive force between the bottom of the straddle assembly and the top of the straddle assembly. The axially compressive force is effective to set the packer/seal assemblies. After setting, the setting tool is removed.

Figure 2:
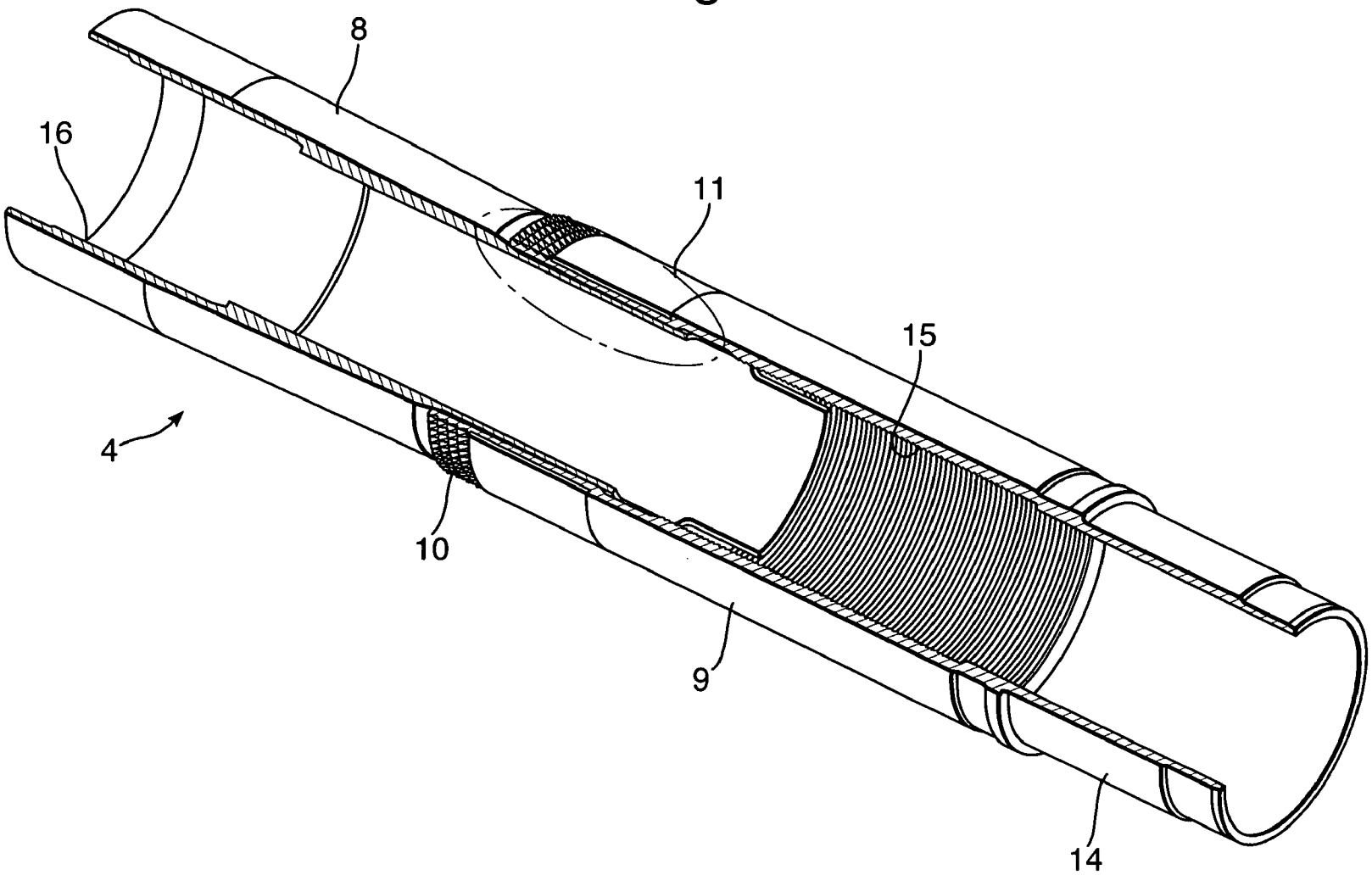
FIG. 2 shows one of the packer/seal assemblies of the straddle assembly of FIG. 1.

The uppermost packer/seal assembly 4 is illustrated in FIG. 2. It is to be understood, however, that all four packer/seal assemblies are substantially identical except in relation to certain features which affect the setting force. These features described in more detail hereinafter.

The packer/seal assembly 4 comprises a swage 8 and a body 9. A slip 10 is provided at one end of the body 9 and is machined to provide outwardly projecting points or teeth for locking engagement with the surrounding well casing. A seal 11 is located adjacent the slip 10 between shoulders 12, 13 provided on the body. At the end of the body 9 remote from the slip 10 an externally threaded pin connection 14 is provided for securing the body to an adjacent component. An internal thread 15 is provided within the body 9.

Figure 5:
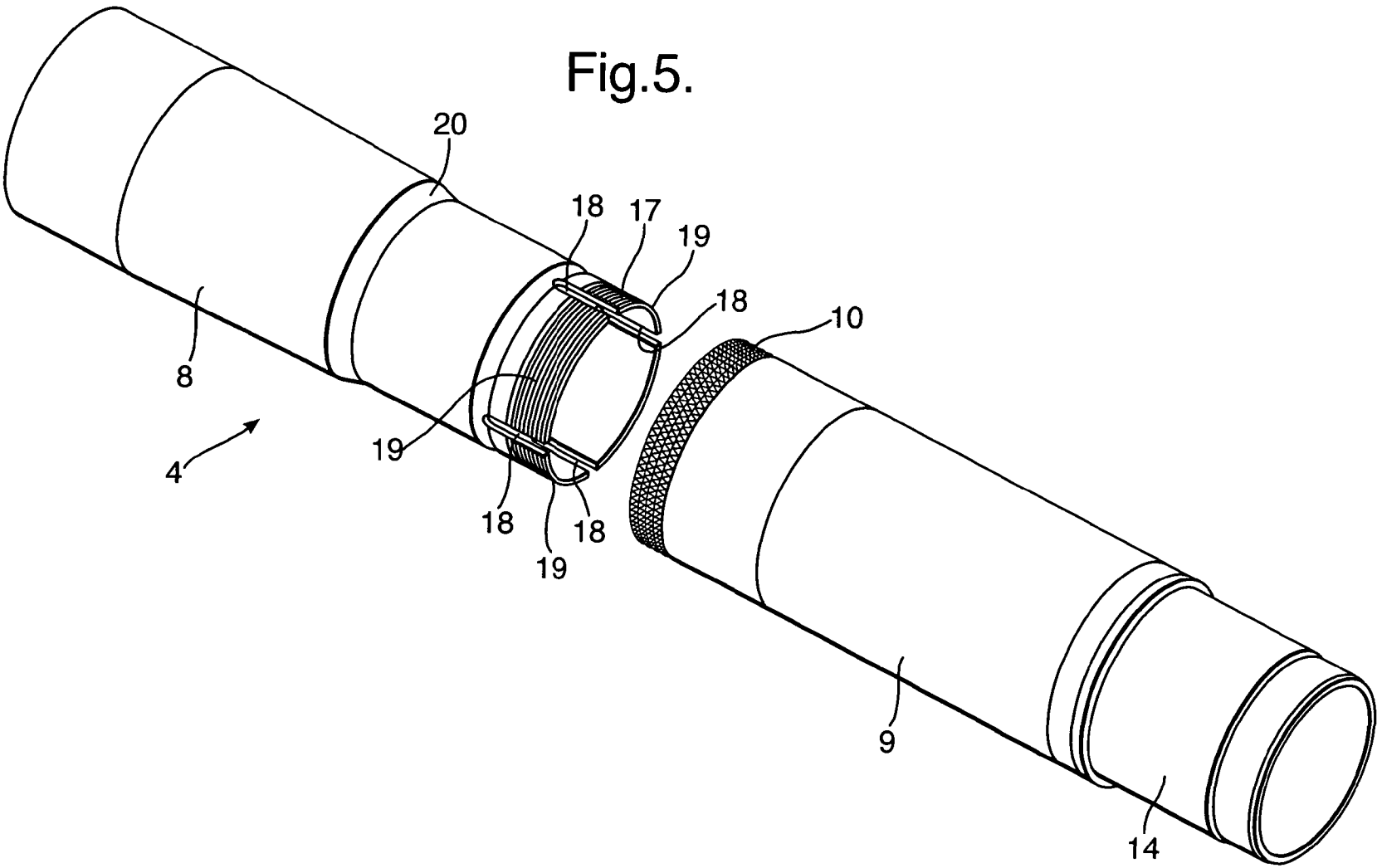
FIG. 5 is an exploded view of the components of the packer/seal assembly of FIG. 2.

The swage 8 has at one end an internally threaded pin connection 16 for connection to adjacent components. At the opposite end of the swage an externally screw threaded portion 17 is divided by a plurality of longitudinally extending slots 18 into a plurality of individual wickers 19. In the arrangement illustrated in FIGS. 2 and 5 four slots 18 are provided and accordingly the threaded portion 17 is divided into four wickers 19. The relative dimensions of the components is such that when the components are in the assembled but unset condition illustrated in FIG. 2 the first few threads of the threaded portion 17 are screw threadingly engaged with the corresponding first few threads of the threaded portion 15. In this configuration, a ramp surface 20 on the swage is in engagement with the axial extremity 21 of the slip, but the slip not has been expanded.

Figure 7:
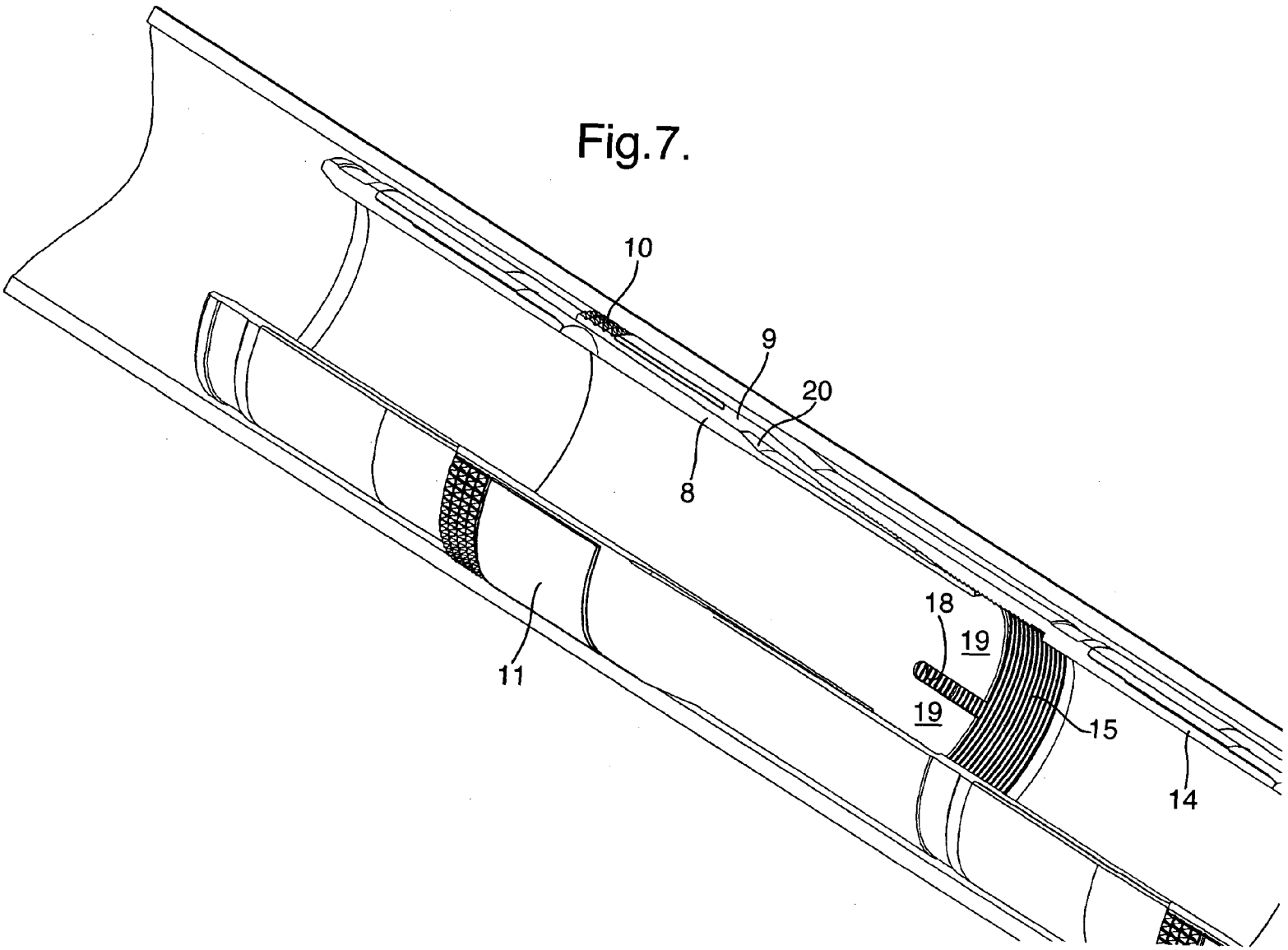
FIG. 7 is a view broken away view showing the various components of the embodiment of FIG. 2 in the configuration they adopt after setting.

With reference particularly to FIG. 2, it will be appreciated that each of the individual packer/seal assemblies can set by applying an appropriately large axially compressive force to the assembly. If the force is large enough, it will drive the swage into the body 9 and the ramp surface 20 will expand the slip 10 into engagement with the surrounding casing. Axial telescoping movement for components will be accommodated by the wickers 19 being cammed inwardly to snap over each successive thread of the threaded region 15. In the set condition of the components illustrated in FIG. 7 not only will the slip be expanded into tight gripping engagement with the surrounding casing, but the seal 11 will have been expanded into sealing engagement with the casing.

Figure 3:
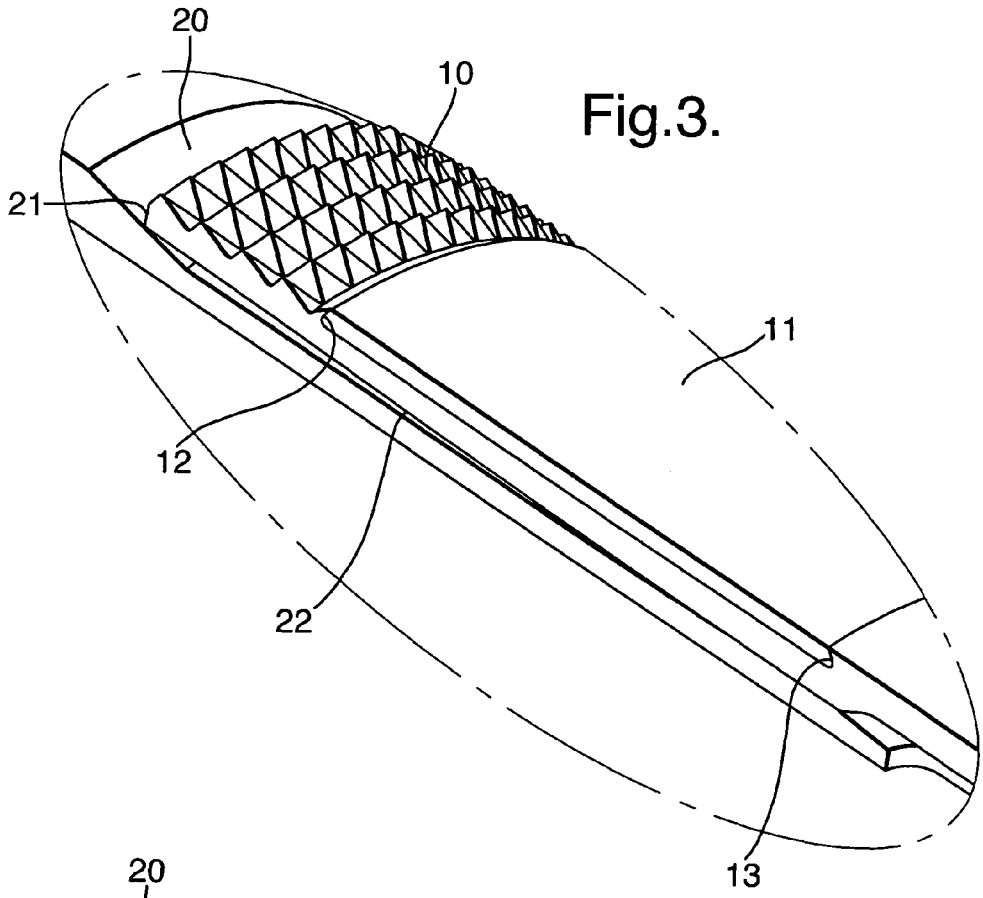
FIG. 3 is a detailed view of the area marked in broken line on FIG. 1.
Figure 4:
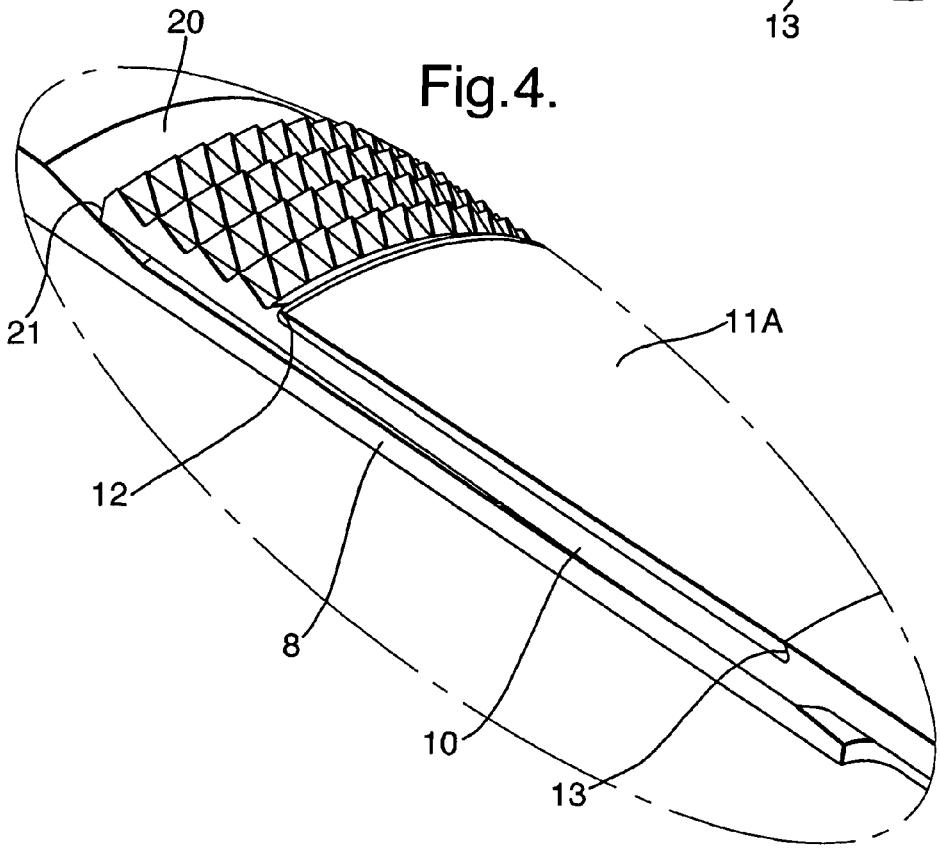
FIG. 4 is a view corresponding to FIG. 3 but showing an alternative embodiment to the invention.

It will be noted that in the arrangement of FIGS. 2 and 3 the seal 11 is of substantially constant radial thickness between the shoulders 12 and 13. In this region the internal diameter 22 of the body 9 increases towards the slip 10 with result that the wall thickness of the body over the length of the seal 11 decreases from a relatively high value adjacent shoulder 13 to a relatively low value adjacent the shoulder 12. Such tapering assists initial expansion of the seal 11 adjacent the slip 10. However, an alternative arrangement as illustrated in FIG. 4 is possible in which the radial thickness of the seal 11A decreases from the shoulder 13 towards the shoulder 12 whilst the radial thickness of the body 10 remains substantially constant over this length.

Figure 6:
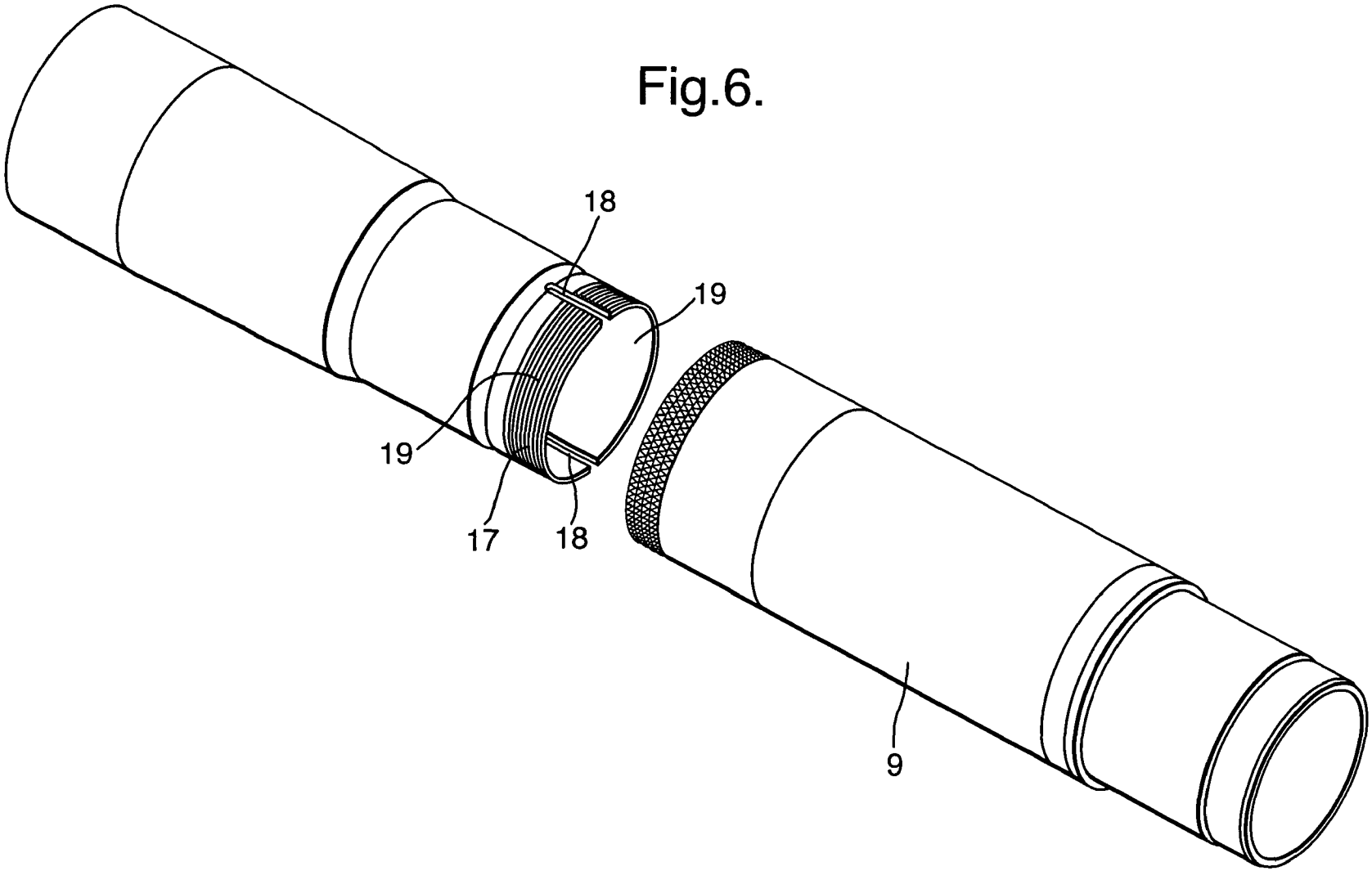
FIG. 6 is a view corresponding to FIG. 5 showing a packer/seal assembly which will require a higher setting force than the packer/seal assembly of FIG. 5.

Referring now to FIG. 6, an exploded view of a packer/seal assembly is shown. The packer/seal assembly of FIG. 6 is identical to the packer/seal assembly of FIG. 5 in all material respects same that in the case of FIG. 6 assembly the threaded regions 17 is interrupted by only two slots 18 and as a result only two wickers 19 are present. All other things being equal the wickers 19 of the FIG. 6 arrangement will be substantially stiffer than the wickers 19 of the FIG. 5 arrangement and accordingly, all other things being equal, the packer/sealer assembly of FIG. 6 will require higher axial setting load than the packer/seal assembly of FIG. 5.

It is envisaged that in an assembly of the type illustrated in FIG. 1 satisfactory setting will be obtained if the outer upper packer/seal assembly 4 is substantially identical to the outer lower packer/seal assembly 6 whilst the upper inner seal assembly 3 is substantially identical to the lower inner seal assembly 5. The packer/seal assemblies 4, 6 will have a higher setting load requirement than the inner packer/seal assemblies 3, 5. Accordingly, if the assembly is run in whole and axially compressed the inner packer/seal assemblies 3, 5 will set before the outer packer/seal assemblies 4, 6. However, it is to be understood the other arrangements are possible within the scope of the present invention. In particular, if it is desired to net the assembly at an accurately defined location it may be better for the packer/seal assemblies to have progressively higher setting force requirements from the top to the bottom. With such an arrangement the tool can be run in whole and the upper end of the tool accurately located at the required level. The upper end of the tool will then be held at that level and the tool compressed from the bottom. This will result firstly in the uppermost packer/seal assembly 4 being set, then the packer/seal assembly 3, then the packer/seal assembly 5 and finally the packer/seal assembly 6. It will be noted that in such an arrangement there is no danger that one of the lower packer/seal assemblies will set prematurely, thereby preventing satisfactory setting of either the upper packer/seal assemblies.

Additionally or alternatively to the above proposals the outer surfaces of the slip 10 may be varied to vary the extent to which they are able to grip the casing. In particular, it may be desirable for the slips associated with the outer most (top and bottom) packer/seal assemblies to have the points of the teeth removed so that they tend, to a limited extent, to slid over the surface of the casing if this is necessary in order to set the inner packer/seal assemblies. In this case obviously the outer slips will contribute less to the overall anchoring force, but the contribution which they make may nonetheless be a valuable addition to the anchoring force provided by the inner slips. Additionally, removing the points from the teeth in this manner will not effect the sealing characteristics of the adjacent seals and accordingly the adjacent seals will add to the overall sealing capacity of the assembly.

The invention claimed is:

1. A well casing straddle assembly comprising: a length of straddle liner having a packer located at either end thereof, wherein the packers require different setting forces so that if the assembly is longitudinally compressed by a setting tool, the packers will set in a predetermined sequence.

2. The well casing straddle assembly according to claim 1, comprising at least two packers at one end of the straddle liner.

3. The well casing straddle assembly according to claim 1, comprising two packers at each end of the straddle liner.

4. The well casing straddle assembly according to claim 3, wherein all the packers require different setting forces so that if the assembly is longitudinally compressed by a setting tool, the packers will set in a predetermined sequence.

5. The well casing straddle assembly according to claim 4, wherein the setting forces required for each respective packer increase progressively from one end of the casing straddle assembly to the other.

6. The well casing straddle assembly according to claim 1, wherein at least two of the packers each comprise an annular slip which, during setting, is expanded into gripping engagement with the surrounding casing by forcing a respective tapering swage into the slip.

7. The well casing straddle assembly according to claim 6, wherein the respective setting forces necessary to set the respective packers are determined by selecting appropriate design characteristics of at least one of each slip and the slip's respective swage.

8. The well casing straddle assembly according to claim 7, wherein a design characteristic of the swage selected to vary the setting force is the ramp angle of the swage.

9. The well casing straddle assembly according to claim 8, wherein the design characteristics selected to vary the setting forces of the packers comprises at least one of the thickness, the material and the metallurgical characteristics of the material of the slips.

10. The well casing straddle assembly according to claim 1, wherein each packer comprises an annular slip and a swage which, when driven into the slip radially expands the slip, wherein the swage is connected to the slip by a ratchet mechanism and wherein the setting force is controlled by the characteristics of the ratchet mechanism.

11. The well casing straddle assembly according to claim 10, wherein the ratchet mechanism of wickers on the swage which engage ratchet teeth connected to the slip and wherein the setting force is determined by the flexibility of the wickers.

12. The well casing straddle assembly according to claim 11, wherein the flexibility of the wickers is controlled by the radial thickness of at least one of the wickers and the circumferential extent of each wicker.

* * * * *